US009301058B2

(12) United States Patent
Puder

(10) Patent No.: US 9,301,058 B2
(45) Date of Patent: Mar. 29, 2016

(54) METHOD FOR SELECTING A PREFERRED DIRECTION OF A DIRECTIONAL MICROPHONE AND CORRESPONDING HEARING DEVICE

(75) Inventor: Henning Puder, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 1035 days.

(21) Appl. No.: 12/644,426

(22) Filed: Dec. 22, 2009

(65) Prior Publication Data

US 2010/0158290 A1 Jun. 24, 2010

(30) Foreign Application Priority Data

Dec. 22, 2008 (DE) ..... 10 2008 064 484

(51) Int. Cl.
*H04R 25/00* (2006.01)
*G10L 21/0216* (2013.01)

(52) U.S. Cl.
CPC ..... *H04R 25/43* (2013.01); *H04R 25/407* (2013.01); *G10L 2021/02166* (2013.01); *H04R 25/40* (2013.01); *H04R 2410/01* (2013.01); *H04R 2430/03* (2013.01)

(58) Field of Classification Search
CPC .. H04R 25/407; H04R 25/405; H04R 25/552; H04R 2225/41; H04R 3/005
USPC ..... 381/94.1, 94.2, 94.5, 313
See application file for complete search history.

(56) References Cited

U.S. PATENT DOCUMENTS 5,119,000 A * 6/1992 Schultz ..... H02P 7/0044 318/293
6,449,593 B1 9/2002 Valve
(Continued)

FOREIGN PATENT DOCUMENTS

DE 10334396 B3 10/2004
DE 60022304 T2 6/2006
EP 1827058 A1 8/2007

OTHER PUBLICATIONS

Meyer et al.: "Multi-Channel Speech Enhancement in a Car Environment using Wiener Filtering and Spectral Subtraction" 1997 IEEE International Conference on Acoustics, Speech, and Signal Processing. Speech Processing, Munich, Apr. 21-24, 1997,[IEEE International Conference on Acoustics, Speech, and Signal Processing (ICASSP)], Los Alamitos, IEEE Comp. Soc. Press, Apr. 21, 199, pp. 1167-1170, XP000822660.
European Search Report dated Mar. 24, 2010.

*Primary Examiner* — Davetta W Goins
*Assistant Examiner* — Jasmine Pritchard
(74) *Attorney, Agent, or Firm* — Laurence A. Greenberg; Werner H. Stemer; Ralph E. Locher

(57) ABSTRACT

The preferred direction of a directional microphone of a hearing device and, in particular, a hearing aid should be selected automatically in a quick and reliable fashion. To this end, provision is made for a method for operating a hearing device with such a microphone which can be switched into at least a first and a second directional characteristic. Initially, respectively one signal-to-noise ratio is determined for the first and the second directional characteristic. Subsequently, the directional microphone is switched into that one of the two directional characteristics which leads to the higher signal-to-noise ratio. In particular, the total signal powers of different directional microphone signals can be determined to this end and the interference signal powers can be calculated in parallel thereto in a channel-specific fashion. Corresponding SNR values then result from the differences in the logarithmic power values.

7 Claims, 2 Drawing Sheets

(56) References Cited

U.S. PATENT DOCUMENTS

2003/0027600 A1 2/2003 Krasny et al.
2005/0058312 A1 3/2005 Weidner
2010/0036659 A1* 2/2010 Haulick ..... G10L 21/0208 704/226

* cited by examiner

METHOD FOR SELECTING A PREFERRED DIRECTION OF A DIRECTIONAL MICROPHONE AND CORRESPONDING HEARING DEVICE

CROSS-REFERENCE TO RELATED APPLICATION

This application claims the priority, under 35 U.S.C. §119, of German application DE 10 2008 064 484.6, filed Dec. 22, 2008; the prior application is herewith incorporated by reference in its entirety.

BACKGROUND OF THE INVENTION

Field of the Invention

The present invention relates to a method for operating a hearing device with a directional microphone which can be switched into at least a first and into a second directional characteristic. Moreover, the present invention relates to a corresponding hearing device. The term "hearing device" in this case is understood to mean any portable sound-emitting equipment in/on the ear or on the head, in particular a hearing aid, a headset, earphones or the like.

Hearing aids are portable hearing devices used to support the hard of hearing. In order to make concessions for the numerous individual requirements, different types of hearing aids are provided, e.g. behind the ear (BTE) hearing aids, hearing aids with an external earpiece (receiver in the canal (RIC)) and in the ear (ITE) hearing aids, for example concha hearing aids or canal hearing aids (ITE, CIC) as well. The hearing aids listed in an exemplary fashion are worn on the concha or in the auditory canal. Furthermore, bone conduction hearing aids, implantable or vibrotactile hearing aids are also commercially available. In this case the damaged sense of hearing is stimulated either mechanically or electrically.

In principle, the main components of a hearing aid are an input transducer, an amplifier and an output transducer. In general, the input transducer is a sound receiver, e.g. a microphone, and/or an electromagnetic receiver, e.g. an induction coil. The output transducer is usually configured as an electroacoustic transducer, e.g. a miniaturized loudspeaker, or as an electromechanical transducer, e.g. a bone conduction earpiece. The amplifier is usually integrated into a signal processing unit. This basic configuration is illustrated in FIG. 1 using the example of a behind the ear hearing aid. One or more microphones 2 for recording the sound from the surroundings are installed in a hearing aid housing 1 to be worn behind the ear. A signal processing unit 3, likewise integrated in the hearing aid housing 1, processes the microphone signals and amplifies them. The output signal of the signal processing unit 3 is transferred to a loudspeaker or earpiece 4 which emits an acoustic signal. If necessary, the sound is transferred to the eardrum of the equipment wearer using a sound tube which is fixed in the auditory canal with an ear mold. A battery 5 likewise integrated into the hearing aid housing 1 supplies the hearing aid and in particular the signal processing unit 3 with energy.

Directional microphones generally amplify signals from the viewing direction of the hearing aid wearer. However, there are situations in which this procedure is more of a hindrance than it is useful; for example, in cars, where the signals from other speakers have a direction of incidence coming more from the side or from behind for the driver or a front-seat passenger. The directional microphone should react to this and focus toward the direction of incidence of the highest speech component.

Until now, only manual switching of the directional characteristic of a directional microphone has been disclosed. However, this manual actuation often leads to discomfort for the user and is not suitable for drivers in particular.

SUMMARY OF THE INVENTION

It is accordingly an object of the invention to provide a method for selecting a preferred direction of a directional microphone and a corresponding hearing device which overcome the above-mentioned disadvantages of the prior art methods and devices of this general type. Thus, the present invention automatically focuses a directional microphone of a hearing device toward the direction of incidence of the highest speech component.

According to the invention, the object is achieved by a method for operating a hearing device with a directional microphone which can be switched into at least a first and a second directional characteristic. The method includes the steps of determining respectively one signal-to-noise ratio for the first and the second directional characteristic; and switching the directional microphone into that one of the two directional characteristics which leads to the higher signal-to-noise ratio.

Moreover, according to the invention, provision is made for a hearing device with a directional microphone which can be switched into at least a first and into a second directional characteristic, a calculation apparatus for determining respectively one signal-to-noise ratio for the first and the second directional characteristic, and a switching apparatus for switching the directional microphone into that one of the two directional characteristics which leads to the higher signal-to-noise ratio.

A determined signal-to-noise ratio is advantageously used as the basis for selecting a directional characteristic of a directional microphone. This selection can be performed automatically and so the hearing aid becomes more comfortable to use for the respective person.

Respectively one interference power is preferably estimated in a plurality of frequency bands for determining the signal-to-noise ratios. In the process, it is particularly advantageous if, for determining the signal-to-noise ratios, respectively one interference power is estimated only in selected frequency bands although the hearing device performs signal processing in a multiplicity of frequency bands. This can save calculation capacity since experience shows that the lower bands hardly contribute in determining the differences in the signal-to-noise ratios for the different directional characteristics.

In accordance with a further preferred embodiment, the interference power is only estimated in one of the frequency bands if noise reduction damps the respective frequency band component to the e.g. predetermined maximum possible value for the utilized filter. This is an indication of this frequency component not containing a speech component. In the other case, i.e. at times when the noise reduction is not applying the maximum damping, this frequency component can be assumed to have a useful signal component. Then, the interference power cannot be estimated; rather the old estimation value is retained until estimating is once again enabled.

The directional microphone can also be switched into one of the directional characteristics by a gradual cross fade. This means that there is not a hard switch at an instant, but rather that the switch is performed softly over a certain interval of time and this possibly increases the hearing comfort.

Moreover, the first directional characteristic can prefer a forward direction and the second directional characteristic can prefer an opposite backward direction. Here, the directional specifications "forward" and "backward" relate to the situation when wearing the hearing device, with "forward" being in the viewing direction of the user.

Furthermore, the directional microphone can be switched into a third directional characteristic which corresponds to an omnidirectional characteristic. This can accommodate a situation in which speech components are incident from a plurality of directions.

Other features which are considered as characteristic for the invention are set forth in the appended claims.

Although the invention is illustrated and described herein as embodied in a method for selecting a preferred direction of a directional microphone and a corresponding hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE INVENTION

The exemplary embodiments explained in more detail below constitute preferred embodiments of the present invention.

Selecting a suitable directional characteristic of a directional microphone is based on estimating a useful component, and in particular a speech component, for, for example, three different setting variants of the directional microphone: a) adaptive with the "forward" direction being preferred, b) omnidirectional and c) "backward" direction being preferred. For speech, the direction could be selected on the basis of the available speech component calculated for each of these three signals on the basis of the height of the 4 Hz modulation of the enveloping ends. The disadvantage of this method is that there is a certain lag in the 4 Hz modulation. This is connected with the necessity of a speaker having to talk for a few seconds from behind before his or her activity is registered and the direction of the directional microphone fades across.

Thus, according to the invention, an alternative for calculating the 4 Hz modulation is proposed, which can, faster and also more reliably, recognize and switch to the preferred direction of the directional microphone. The idea is based on a specific and very complexity-efficient calculation of the signal-to-noise ratio (SNR) for each of the in this case three different setting variants of the directional microphone. This is based on the three output signals of the three different directional microphone variants, for example in 48 frequency bands in which the directional microphone is currently being calculated.

Figure 1:
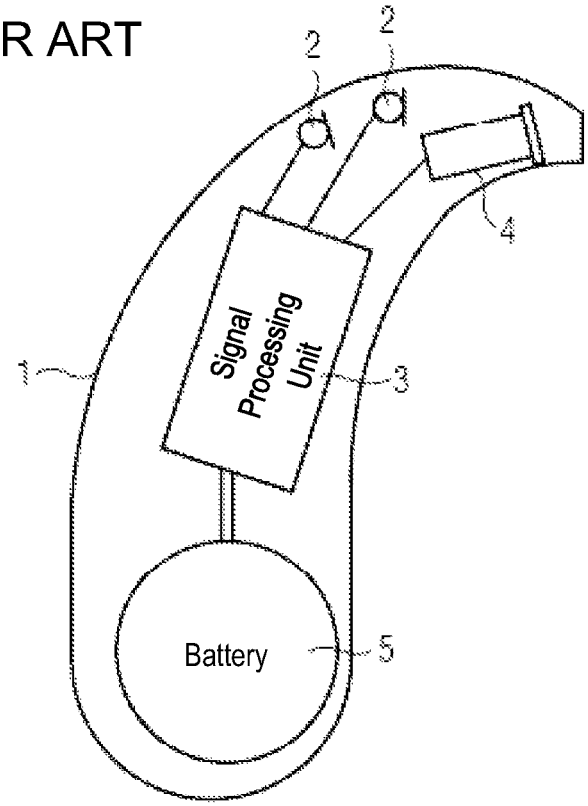
FIG. 1 PRIOR ART
FIG. 1 is a schematic view of a basic configuration of a hearing aid according to the prior.
Figure 2:
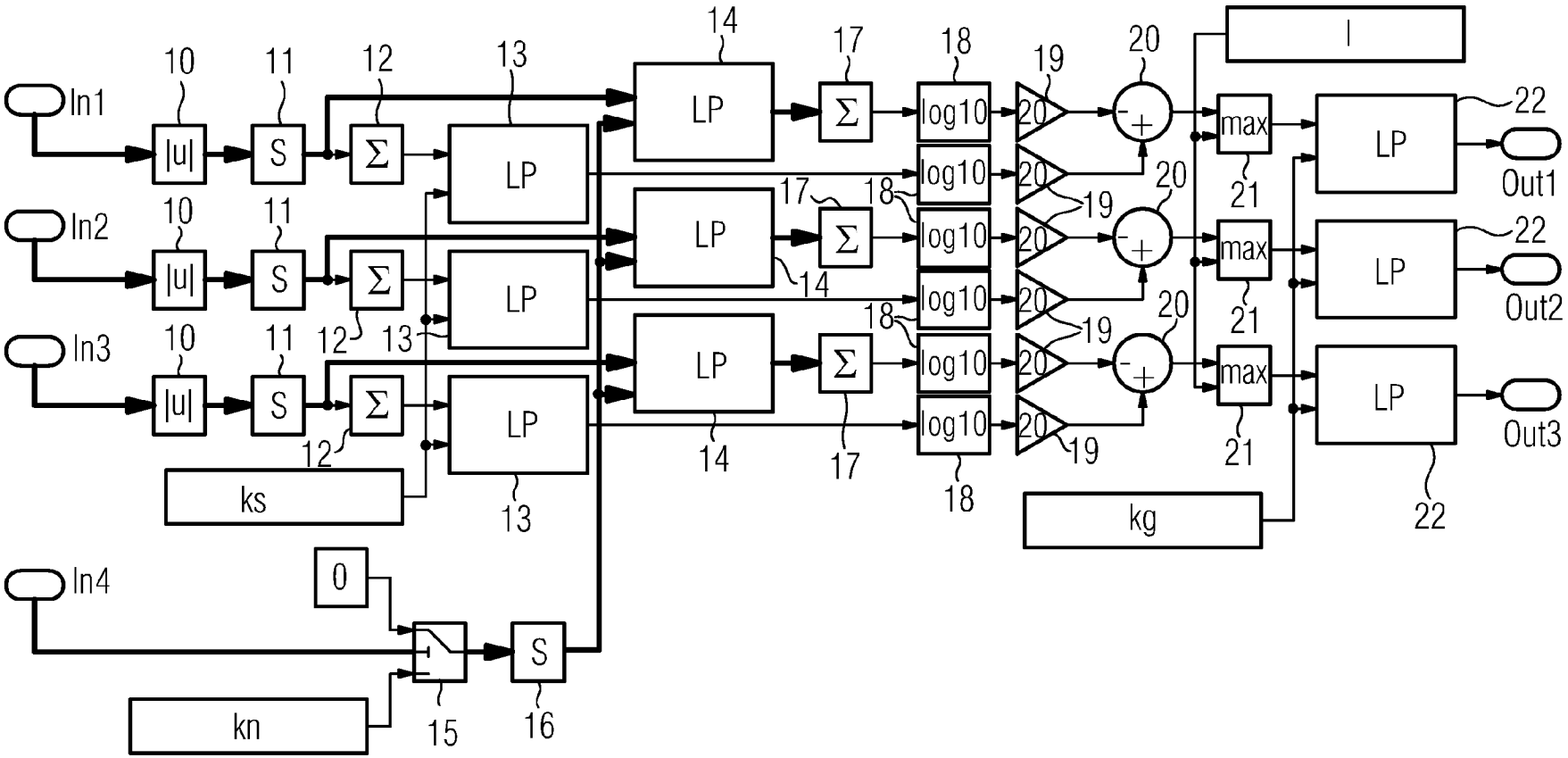
FIG. 2 is a block diagram of a circuit configuration for a hearing aid for automatically selecting a suitable directional characteristic of a directional microphone according to the invention.

An exemplary detection system for recognizing the largest speech component in the three different directional microphone settings is now explained in more detail on the basis of FIG. 2. The detection system, which can for example be integrated into a hearing aid as part of a directional microphone control unit, obtains, respectively in multichannel form (the thick lines in FIG. 2), an input signal In1 from an "omnidirectional" directional microphone setting, an input signal In2 from a "forward direction" directional microphone setting and an input signal In3 for the "backward direction" directional microphone setting. The SNR is estimated for each of the input signals. To this end, the power of the respective overall signal is initially determined. To this end, absolute value units 10 form the magnitude of each input signal in a band-specific or channel-specific fashion. In each signal path, a selector 11 is arranged downstream of the absolute value unit 10 for selecting only the desired bands. In particular, the lower bands are generally not selected because they do not usually contribute to distinguishing the three signals. Subsequently, the signals of the remaining bands are summed in adders 12. Thus, this results in respectively one broadband overall signal (the blocked bands do not contribute) for each multiband input signal In1, In2, In3, which broadband overall signal is used for estimating the power of the overall signal (S+N) in a corresponding estimation apparatus 13. By way of example, every estimation apparatus 13 has a low-pass filter LP. So as to be able to estimate the overall power appropriately, every estimation apparatus 13 requires a fixed, predetermined smoothing constant ks.

Parallel to estimating the power of the overall signal (S+N), the power of the interference (N) is also estimated for each input signal In1, In2, In3. To this end, the selected bands are supplied, in a multichannel or multiband fashion, to further estimation apparatuses 14 after the selectors 11 (in FIG. 2, multichannel connections are drawn in thick lines and single channel connections are drawn in thin lines). Such an estimation apparatus 14 for multichannel processing can contain an IIR filter, for example a first-order low-pass filter. Thus, the interference power is calculated in each of these estimation apparatuses 14 in a channel-specific fashion. To this end, the respective estimation apparatus 14 also requires a fixed smoothing constant kn. However, in the process, the fact that the interference power can only be reliably estimated if there is no useful power in the respective band has to be taken into account. By way of example, the information from a Wiener-based noise reduction can be used to this end. This is effected by virtue of the fact that an evaluation is performed in each frequency band as to whether the noise reduction at the current instant is damping the respective frequency component maximally, or whether a certain component is passed. If a predetermined maximum damping is applied, the assumption can be made that only noise is present and the estimation can be enabled. In the other case, estimating is suspended and the old estimated value is retained until the estimation is once again enabled.

Information in respect of whether or not the maximum damping is effected by the noise reduction can be input at a further input In4 in a channel-specific fashion. On the basis of the respective channel-specific function, a switch 15 switches the smoothing constant to kn if only noise is present; else it switches the constant to 0 if a useful signal is also present at the selected time. A further selector 16 selects that output channel from the output channels of the switch 15 which the selectors 11 have also selected from the input signals. The interference power can now be estimated in a channel-specific fashion in the estimation apparatuses 14 on the basis of the additional information as to when the noise reduction is performed in the individual bands.

The channel-specific interference powers are added over all frequency bands in adders 17. Thus, this results in an overall interference power for each of the three input signals. Respectively one level (in dB) of the overall interference powers and the overall signal powers is formed by further processing elements 18 and 19. Subtractors 20 form the difference between the levels of overall signal power and interference power for each input signal. This difference provides an estimate of the SNR value. Hence, this makes it possible for estimates to be performed for the three microphone variants.

The SNR values are optionally also subjected to smoothing at the end of the detection system. To this end, they are initially compared to a limit l in comparator units 21. The respectively larger value is output. Thus, if the SNR undershoots the value l, the output value is set to the limit l. This can avoid a switch already being made at a very low SNR. Subsequently, the resultant values are smoothed by low-pass filters 22 with a smoothing constant kg. The smoothed output signals Out1, Out2 and Out3 can now be used for further signal processing. By way of example, in the mentioned sequence, these signals represent the SNR value for omnidirectional operation, the SNR value for directional operation and the SNR value for antidirectional operation (opposite direction). In the process, the three values are for example compared, and that variant with the largest SNR value is used to select the most expedient directional microphone variant by use of a hysteresis logic (which, like the just mentioned comparator elements, is not illustrated in FIG. 2).

Thus, the best directional microphone variant, i.e. the variant with the highest speech component, can advantageously be selected on the basis of the SNR. The complexity-expedient coupling with the noise reduction, which affords the possibility of simple noise estimation for each of the three directional microphone variants, should be highlighted in particular.

Investigations show that the optimum directional microphone variant is selected faster and more reliably. Correct detection rates of over 90% can be achieved.

The invention claimed is:

1. A method for operating a hearing device with a directional microphone which can be switched into at least a first directional characteristic and a second directional characteristic, which comprises the steps of:

estimating a band-specific interference power in only frequency bands of the first and second direction characteristics in which a noise reduction algorithm applies a predetermined maximum damping;

determining one signal-to-noise ratio for each of the first directional characteristic and the second directional characteristic, based at least in part on the band-specified interference power; and switching the directional microphone into the one of the first and second directional characteristics which leads to a higher signal-to-noise ratio.

2. The method according to claim 1, which further comprises performing via the hearing device signal processing in the plurality of frequency bands and the one interference power is estimated only in selected frequency bands for determining the signal-to-noise ratios.

3. The method according to claim 1, wherein a switch is performed by a gradual cross fade.

4. The method according to claim 1, wherein the first directional characteristic represents a forward direction and the second directional characteristic represents an opposite backward direction.

5. The method according to claim 1, wherein the directional microphone can be switched into a third directional characteristic corresponding to an omnidirectional characteristic.

6. A hearing device, comprising:

a directional microphone which can be switched into at least a first directional characteristic and a second directional characteristic;

a calculation apparatus for determining one signal-to-noise ratio for each of the first directional characteristic and the second directional characteristic, the signal-to-noise ratio being determined based at least in part from a band-specific interference power; and a switching apparatus for switching said directional microphone into the one of the first and second directional characteristics which leads to a higher signal-to-noise ratio, said calculation apparatus estimating respectively the band-specific interference power in only frequency bands of the first and second directional characteristic in which a noise reduction unit applies a predetermined maximum damping.

7. The hearing device according to claim 6, wherein said calculation apparatus can perform signal processing in the plurality of frequency bands and the one interference power is estimated only in selected frequency bands.

* * * * *